US006409036B2

(12) United States Patent
Martin

(10) Patent No.: US 6,409,036 B2
(45) Date of Patent: Jun. 25, 2002

(54) INTERLOCKING CONTAINER

(76) Inventor: Gary F. Martin, 323 Narcissus Ave., Corona del Mar, CA (US) 92625

( * ) Notice: Subject to any disclaimer, the term of this patent is extended or adjusted under 35 U.S.C. 154(b) by 0 days.

(21) Appl. No.: 09/765,627

(22) Filed: Jan. 22, 2001

Related U.S. Application Data

(60) Provisional application No. 60/177,279, filed on Jan. 21, 2000.

(51) Int. Cl.[7] ..... B65D 6/26
(52) U.S. Cl. ..... 220/4.28; 220/552
(58) Field of Search ..... 220/4.28, 552, 220/507, 503, 554, 505, 504

(56) References Cited

U.S. PATENT DOCUMENTS 1,912,505 A * 6/1933 Weston ..... 220/552
2,903,127 A * 9/1959 Dorman ..... 220/552
5,198,127 A * 3/1993 Tilley et al. ..... 220/552
5,593,058 A * 1/1997 Spencer et al. ..... 220/4.28
5,743,421 A * 4/1998 Gonzalez et al. ..... 220/4.28
5,806,708 A * 9/1998 Schwab ..... 220/552

* cited by examiner

*Primary Examiner*—Stephen Castellano
(74) *Attorney, Agent, or Firm*—Liniak, Berenato, Longacre & White

(57) ABSTRACT

An interlocking container comprising a number of mutually interlocking plate forming the container that may be used for a plurality of various applications such as a vase, a pencil cup, a trash can, a support for a clock, or the like. The interlocking plates consist of a series of commonly formed printable pieces that interlock to form a variety of containers having unique geometric configuration.

17 Claims, 5 Drawing Sheets

INTERLOCKING CONTAINER

This application claims benefit of provisional application Ser. No. 60/177,279 filed Jan. 21, 2000.

BACKGROUND OF THE INVENTION

1. Field of the Invention

This invention relates to a container assembled from a plurality of interlocking plates manufactured with a uniform configuration adapted for ease of manufacture and assembly. More specifically, the interlocking plates consist of a series of commonly formed pieces that interlock to form a variety of containers having unique geometric configuration.

2. Description of Related Art

The prior art replete with container formed by a variety of containers assembled from foldable or assembled and preformed members. However, such devices do not satisfy the need for printable uniformly designed plates that provide unique geometric and visual aesthetics.

In addition, conventional containers do not typically permit storage and transport in a disassembled condition, thus ease and cost to efficiently and effectively store and transport the conventional container can not be achieved.

SUMMARY OF THE INVENTION

The present invention provides an interlocking container comprising a number of mutually interlocking plate forming the container that may be used for a plurality of various applications such as a vase, a pencil cup, a trash can, a support for a clock, or the like.

In the preferred embodiment, the interlocking plates consist of a series of commonly-formed and printable pieces that interlock to form a variety of containers having unique geometric configuration. The material forming the invention is selected from any one of rubber, vinyl, paper, paper-based product, plastic, polyethylene, polypropylene, etc and may take any one of an infinite number of shapes, textures and colors.

The devices may receive printing in the forms of logos, promotional material, and advertisements.

These and other benefits provided by the instant invention will be apparent in light of the following description and associated drawings.

DETAILED DESCRIPTION OF PREFERRED EMBODIMENTS

Figure 1A:
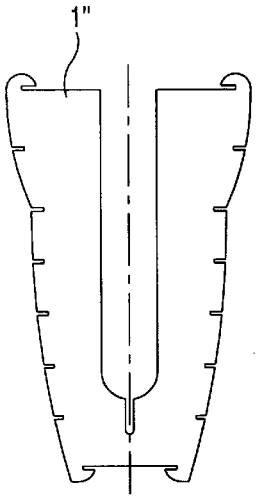
FIGS. 1*a*–1*c* show a first group of plates (vertical) forming a part one embodiment of the instant invention.
Figure 1B:
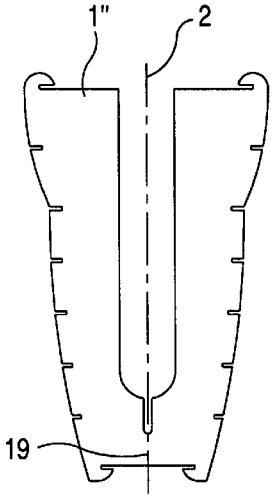
Figure 1C:
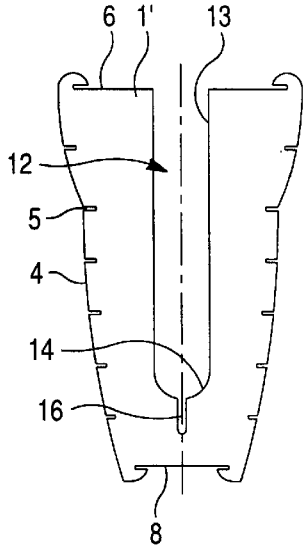
Figure 2A:
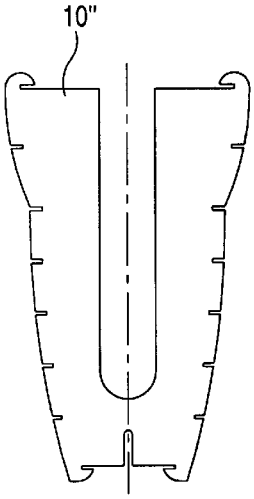
FIGS. 2*a*–2*c* show a second group of plates (vertical) forming a part of one embodiment of the instant invention.
Figure 2B:
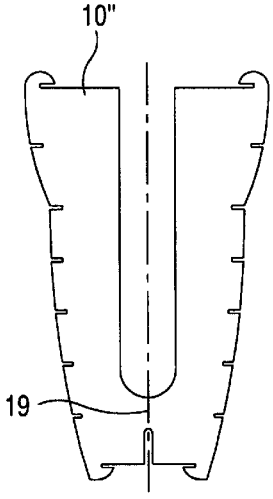
Figure 2C:
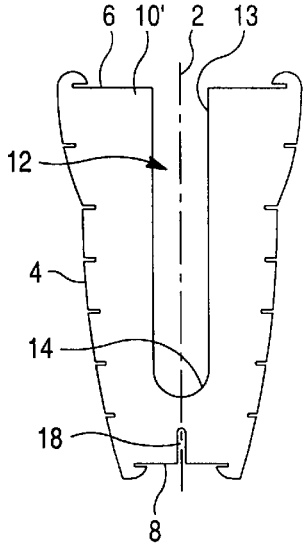
Figure 3A:
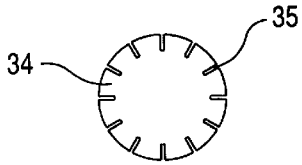
FIGS. 3*a*–3*h* show a series of circular plates (horizontal) forming a part of one embodiment of the instant invention.
Figure 3E:
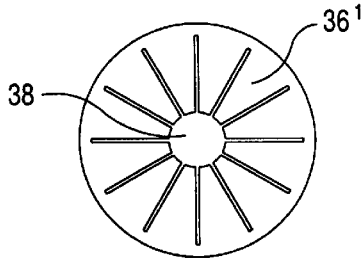
Figure 3B:
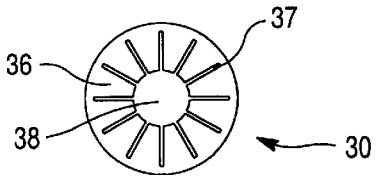
Figure 3F:
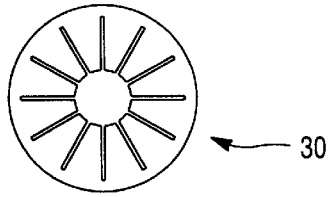
Figure 3C:
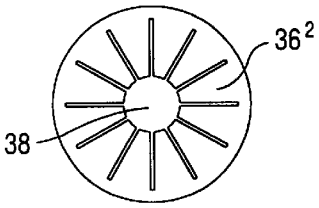
Figure 3G:
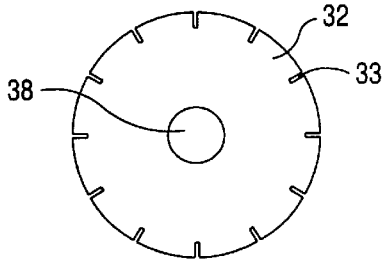
Figure 3D:
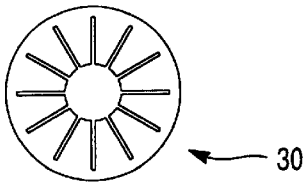
Figure 3H:
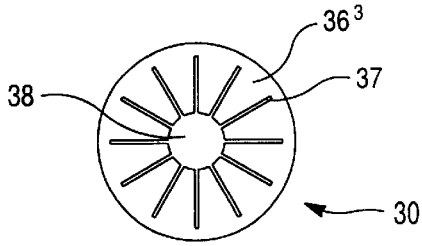

FIGS. 1*a*–4 show a first embodiment of the invention. In the first embodiment of the invention, the container comprises two sets of substantially elongated plates 1, illustrated in FIGS. 1, and 10, illustrated in FIG. 2, and a set of substantially circular plates 30 of various external diameters, illustrated in FIG. 3.

Each set of elongated plates includes a plurality (preferably three) of substantially identical flat plates made of any suitable relatively thin, but sufficiently rigid material, such as die-cut metal, wood, plastic, cardboard, etc. Various type of information may be printed of the surface of the plates 1 and 10. In the preferred embodiment, each of the plates 1 and 10 is generally symmetrical relative to an axis 2, and includes a pair of side surfaces 4, a first end surfaces 6 and a second end surface 8, both substantially perpendicular to the axis 2. Each of the plates 1 or 10 is provided with a notch 12 with an opening in the first end surfaces 6. The notch 12 is substantially coaxial to the axis 2, and includes sidewalls 13 and an endwall 14. Furthermore, an assembly notch 16 is formed in the plates 1 or 10. However, the assembly notch of the plates 1 is formed at the endwall 14 substantially coaxial to the axis 2 with an opening facing the notch 12. In contrast, the assembly notch 18 in the plates 10 is formed in the endwall 8. Also, the plates 1" and 10" are provided with a folding line 19 defined by a number of perforations or weakening in those plates 1" and 10".

The sidewalls 4 of the plates 1 and 10 are provided with a plurality of notches 5 generally perpendicular to the axis 2 and corresponding to the number of circular plates 30.

Figure 4:
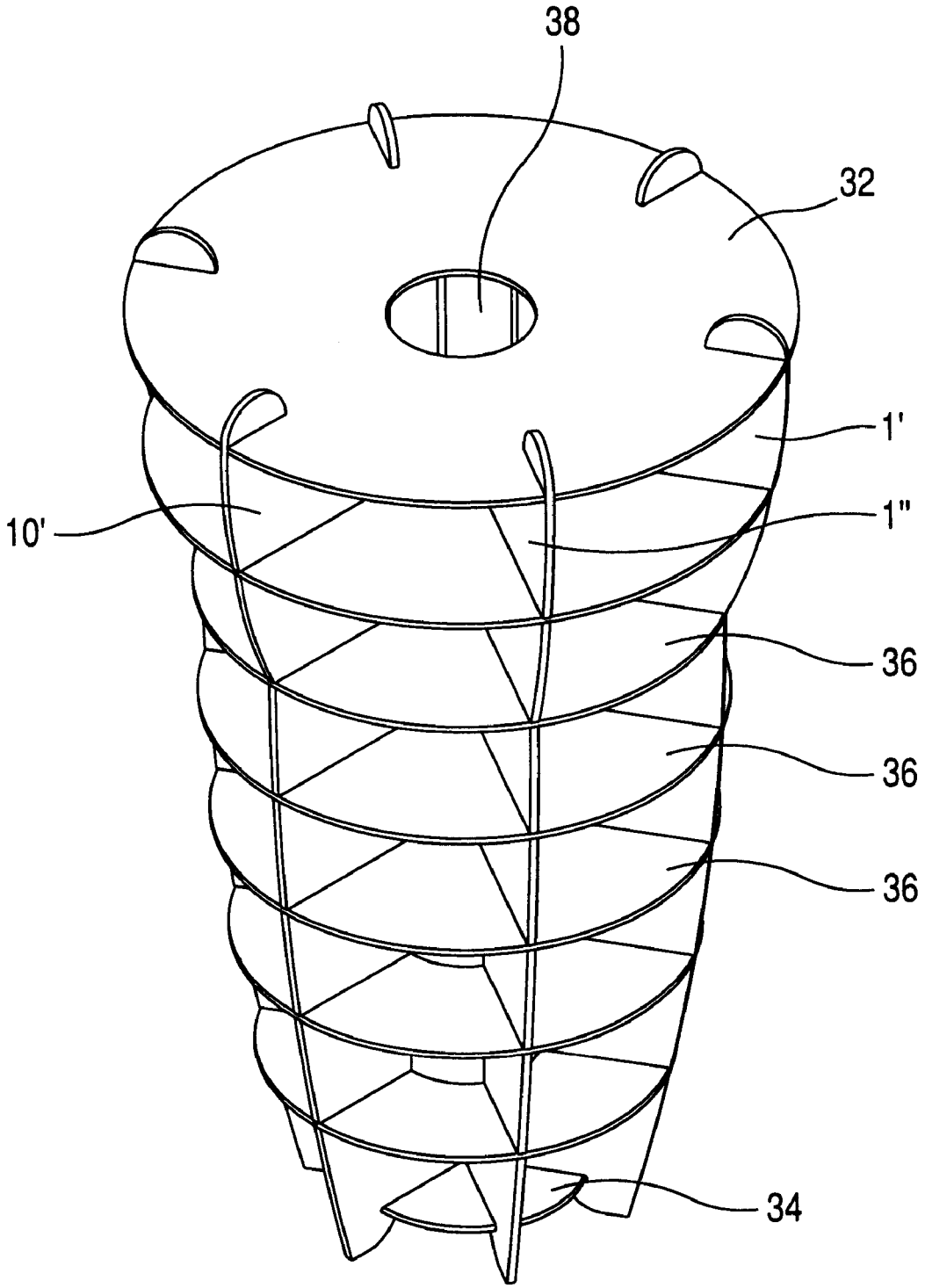
FIG. 4 is a perspective view of the container formed according to the first embodiment of the instant invention.
Figure 5:
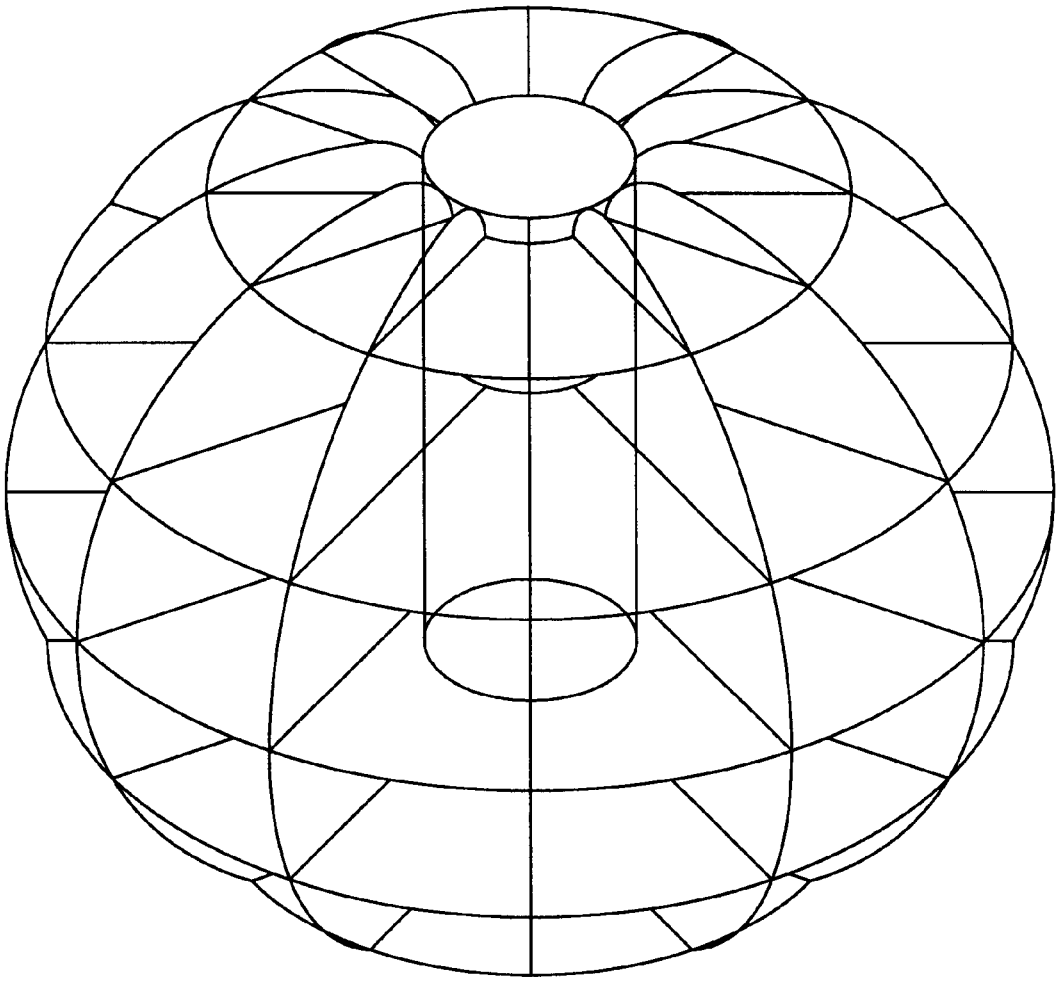
FIG. 5 is a perspective view of the container formed according to a second embodiment of the instant invention.
Figure 6:
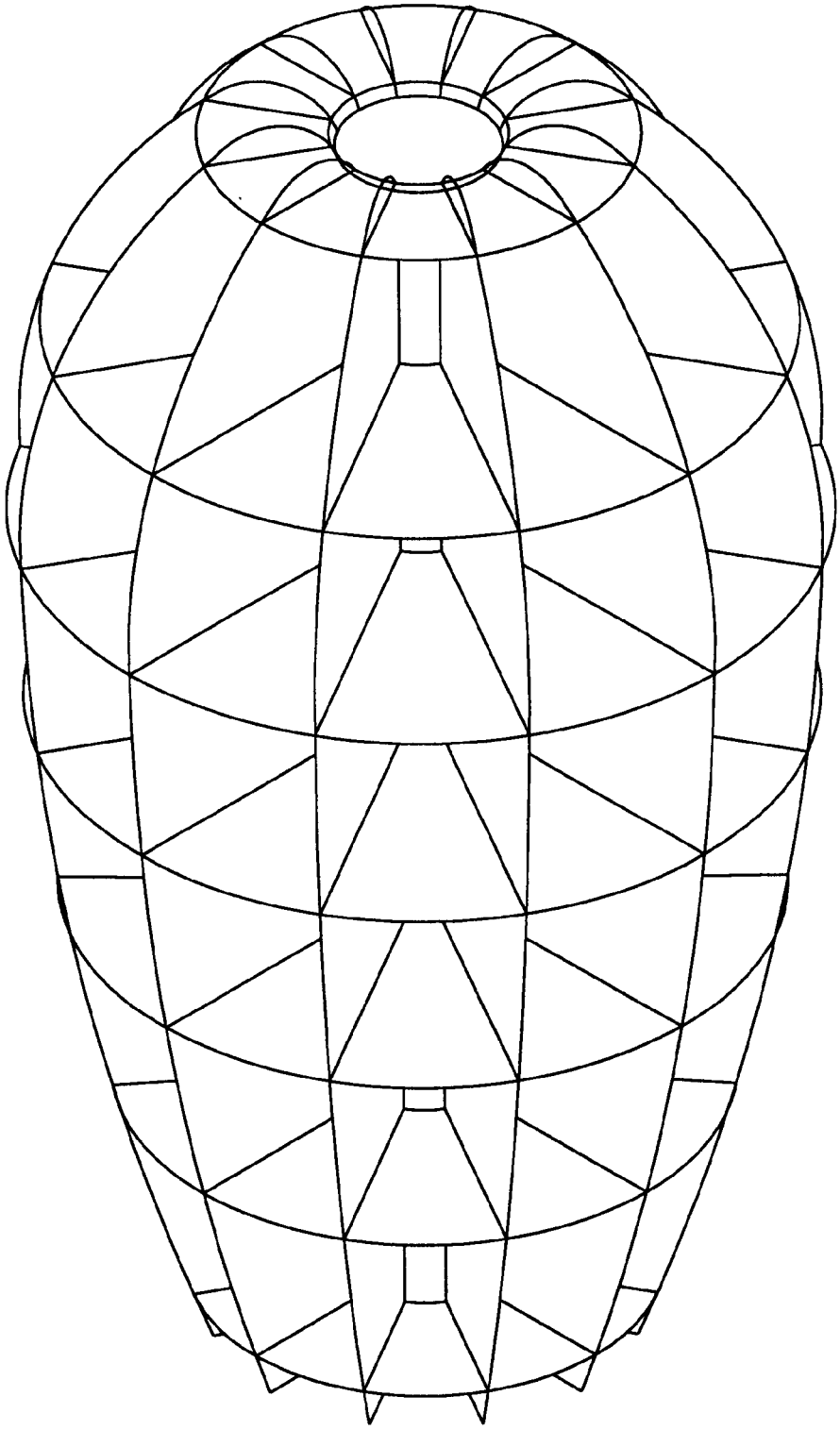
FIG. 6 is a perspective view of the container formed according to the first embodiment of the instant invention.

The set of circular plates 30, illustrated in FIG. 3, comprises a first end circular plate 32, a second end circular plate 34 and a plurality of intermediate circular plates $\mathbf{36}_1$–$\mathbf{36}_n$, where n is any whole number other than 1. The first end circular plate 32 and the intermediate circular plates $\mathbf{36}_1$–$\mathbf{36}_n$ are provided with a central aperture 38 having generally the same diameter to thereby define a recessed containment area in combination with the notches 12 provided in each of the elongated plates 1 and 12, as illustrated in FIGS. 4–6. The recessed containment area gas a bottom and an open top, and is adapted to receive and support at least one article therein, such as a vase, pencils, flowers, etc.

Moreover, the first end circular plate 32 is provided with a plurality of substantially radial notches 33 formed on the outer periphery thereof and spaced generally uniformly. Similarly, the second end circular plate 34 is provided with the equal number of substantially radial notches 35 formed on the outer periphery thereof and spaced generally uniformly. Each of the intermediate circular plates $\mathbf{36}_1$–$\mathbf{36}_n$ is provided with the corresponding number of notches 37 extending radially outwardly from the aperture 38.

It would be appreciated that the elongated plates 1 and 10 may be shipped flat to provide an efficient and economical system of delivery to the customer. Moreover, the elongated plates 1, 10 are suitable for printing and/or affixing print media for advertisements, logos, artwork, educational information, etc.

The collapsible container is assembled as follows:

first, one of the plates 1 of the first is interconnected to one of the plates 10 of the second set by sliding the assembly notch 16 into the assembly notch 18 while oriented generally perpendicular to each other;

then, each the remaining two plates 1' and 1" of the first set, is folded along the folding line 19 forming an angle of approximately 60, then each of the plates 1' and 1" is slid into the assembly notch 18 of the plate 10 opposite to each other;

similarly, each the remaining two plates 10' and 10" of the second set, is folded along the folding line 19 forming an angle of approximately 60, then each of the plates 1' and 1" is slid into the assembly notch 16 of the plate 1 opposite to each other;

finally, the circular plates 30 is attached to the elongated plates 1 and 10 by inserting the elongated plates into notches 37 of the intermediate plates 36 until they interlock with the notches 5 of the elongated plates; after that the first and second circular end plates 32 and 34 are interlocked with the first and second end surfaces 6 and 8 of the elongated plates.

An example of the assembled container is shown in FIG. 4. For the sake of clarity and simplicity, only three elongated plates are shown, instead of six. FIGS. 5 and 6 show alternate embodiments of the present invention whereby the container is formed and configured to have spherical and oval shapes, respectively. The embodiments of FIGS. 5 and 6 evidence the unique versatility of the present invention because there exist an infinite number of possible shapes for the container simply by cutting plates having an outer contour that achieves the desired shape without sacrificing stability or printability.

Thus, it would be appreciated that the above-described interlocking plates may be of various sizes and shapes depending on the particular application of the container.

The foregoing description of the preferred embodiment of the present invention has been presented for the purpose of illustration. It is not intended to limit the invention to the precise forms disclosed. Obvious modifications or variations are possible in light of the above teachings. The embodiment disclosed hereinabove was chosen in order to best illustrate the principles of the present invention and its practical application to thereby enable those of ordinary skill in the art to best utilize the invention in various embodiments and with various modifications as are suited to the particular use contemplated, as long as the principles described herein are followed.

I claim:

1. A container having an axis of symmetry, comprising:

a plurality of first oriented plates in an spaced relationship about said axis of symmetry, said first plates formed with a plurality of locking grooves, a plurality of second parallely oriented plates each formed with a plurality of interlocking grooves interlocking with said locking grooves of said first plates, wherein at least one of said second parallely oriented plates circumscribes at least one of said first oriented plates to thereby retain said first and second plates in relatively fixed spatial relation and defines a recessed containment area extending along said axis of symmetry, said recessed containment area having a bottom and an open top and adapted to receive and support at least one article therein.

2. A container having an axis of symmetry, comprising:

a plurality of vertically oriented plates formed with a plurality of locking grooves, said plates are radially extending through said axis in an angularly spaced relationship thereabout;

each of said vertically oriented plates provided with a notch having an opening in one end surface of said plate, said notch is substantially coaxial to said axis;

a plurality of horizontally oriented plates formed with a plurality of interlocking grooves interlocking with said locking grooves of said vertically oriented plates, wherein at least one of said horizontally oriented plates circumscribes at least one of said vertically oriented plates, and wherein said notch provided in each of said vertically oriented plates defines a recessed containment area extending along said axis of symmetry, said recessed containment area having a bottom and an open top and adapted to receive and support at least one article therein.

3. The container of claim 2, wherein at least one of said vertically oriented plates is formed with a downwardly oriented groove.

4. The container of claim 3, wherein at least one of said vertically oriented plates is formed with an upwardly oriented groove adapted to interlock with said downwardly oriented groove.

5. The container of claim 2, wherein aid locking grooves are formed on an exterior edge of said vertically oriented plates.

6. The container of claim 2, wherein said interlocking grooves are formed on an interior edge of said horizontally oriented plates.

7. The container of claim 2, wherein said interlocking grooves of at least one of said horizontally oriented plates is greater than or equal in number of said vertically oriented plates.

8. The container of claim 2, wherein at least one of said horizontally oriented plates defines a circular perimeter.

9. The container of claim 8, wherein a first plate of said horizontally oriented plates has a different circular perimeter than a second plate of said horizontally oriented plates.

10. The container of claim 2, wherein at least one of said horizontally oriented plates comprises a central aperture.

11. The container of claim 10, wherein a plurality of said horizontally oriented plates comprise a central aperture and wherein each of said central apertures is aligned along said axis.

12. The container of claim 2, wherein a plurality of said vertically oriented plates is substantially identical in profile.

13. A container having a vertical axis of symmetry, comprising:

a plurality of vertically oriented plates formed with a plurality of locking grooves, said a plurality of horizontally oriented plates disposed in parallel relation to each plates are radially extending through said axis in an angularly spaced relationship thereabout;

each of said plates provided with a notch having an opening in one end surface of said plate, said notch is substantially coaxial to said axis;

a plurality of horizontally oriented plates disposed in parallel relation to each other, at least one vertically oriented plates formed with a downwardly oriented groove and at least one vertically oriented plate formed with an upwardly oriented groove adapted to interlock with said downwardly oriented groove, wherein at least one of said horizontally oriented plates comprises series of grooves equal in number to a number of said vertically oriented plates for interlocking with said locking grooves of said vertically oriented plates, and wherein said notch provided in each of said vertically oriented plates defines a recessed containment area extending along said axis of symmetry, said recessed containment area having a bottom and an open top and adapted to receive and support at least one article therein.

14. The container of claim 13, wherein said horizontally oriented plates define circular perimeters.

15. The container of claim 14, wherein each of said horizontally oriented plates has different circular perimeters.

16. The container of claim 13, wherein each of said horizontally oriented plates comprises a central aperture.

17. The container of claim 16, wherein each of said central apertures is aligned along said axis.

* * * * *